US005303280A

United States Patent [19]

Crawford et al.

[11] Patent Number: 5,303,280

[45] Date of Patent: Apr. 12, 1994

[54] LARGE DIAMETER ANODE X-RAY TUBE WITH REINFORCED SUPPORT

[75] Inventors: Robert C. Crawford, St. Charles; Mark S. Maska, Palatine, both of Ill.

[73] Assignee: Picker International, Inc., Highland Hts., Ohio

[21] Appl. No.: 982,478

[22] Filed: Nov. 27, 1992

[51] Int. Cl.[5] ..... H01J 35/10

[52] U.S. Cl. ..... 378/132; 378/125

[58] Field of Search ..... 378/132, 133, 131, 128, 378/125

[56] References Cited

U.S. PATENT DOCUMENTS 2,230,858 2/1941 Atlee ..... 378/132

2,274,865 3/1942 Machlett ..... 378/128

*Primary Examiner*—Craig E. Church

*Attorney, Agent, or Firm*—Fay, Sharpe, Beall, Fagan, Minnich & McKee

[57] ABSTRACT

An anode assembly (14) is mounted by a bearing assembly (20–28) in a bearing housing (30). The bearing housing is constructed of substantially pure copper or other high thermal conductivity metal. The bearing housing defines a shoulder portion (36) between a side wall (34) and a mounting shank (38). The mounting shank is threaded (66) to be clamped into a mounting assembly (60) which provides substantially the sole support for the bearing and anode assembly. A steel reinforcing collar (52) with an integral seat portion (54) supports the shank and shoulder portions of the bearing housing. A vacuum envelope (40) of the x-ray tube includes a metal cap portion (44) which is sealed between the seat and shoulder portions in a vacuum tight relationship. In this manner, relatively soft substantially pure copper is used in the bearing housing to conduct thermal energy from the anode while the reinforcing collar provides sufficient structural strength that the weight of the cantilever mounted anode and bearing assembly to resist deformation of the copper shank and shoulder portion.

16 Claims, 3 Drawing Sheets

LARGE DIAMETER ANODE X-RAY TUBE WITH REINFORCED SUPPORT

BACKGROUND OF THE INVENTION

The present invention relates to the mounting and support arts. It finds particular application in conjunction with the mounting of large diameter anode x-ray tubes and will be described with particular reference thereto. It is to be appreciated, however, that the invention may also find application in conjunction with the mounting of x-ray tubes of other design and in other applications in which heat transfer from a cantilevered load through the mounting arrangement is required.

In early x-ray tubes, electrons from a cathode filament were drawn at a high voltage to a stationary target anode. The impact of the electrons caused the generation of x-rays as well as significant thermal energy. As higher power x-ray tubes were developed, the thermal energy became so large that extended use damaged the anode.

One way to distribute the thermal loading and reduce anode damage was to use a rotating anode. The electron beam was focused near a peripheral edge of an anode disk. As the anode rotated, the portion of the anode where x-rays were generated moved along an annular ring. Each spot along the annular path was heated to a very high temperature during the generation of x-rays and cooled as it rotated before it returned for the generation of x-rays. If the path of travel was too short, the target area on the anode would still contain sufficient thermal energy that the added thermal energy from the electron beam caused thermal damage to the anode surface. Accordingly, as higher power x-ray tubes were developed, the diameter and the mass of the anode continued to grow.

Typically,.the anode was mounted on a stem which was supported by a bearing assembly. In one technique for removing thermal energy, the bearings were contained in a copper housing which was integrally connected with a copper shank. A vacuum envelope, typically glass, surrounded the cathode, rotating anode, and bearing assembly. The copper shank extended from the vacuum envelope providing both a thermal path for removing heat energy from within the envelope and a metal mounting element for the anode and bearing assembly. Typically, the x-ray tube was mounted in a cantilevered arrangement by the copper shank.

In today's CT scanners with high gantry rotational speeds, x-ray tubes with massive rotating anodes are still mounted in a cantilevered fashion by a thermally conductive shank at one end. Although additional support is provided for the evacuated envelope, the anode and bearing assembly is supported solely by the shank. The evacuated envelope is surrounded by an oil bath for removing the excess thermal energy. Under the weight of the large anode, the shaft tends to bend or deform, allowing the anode structure to sag. Even a slight deformation or wobble alters the x-ray beam sufficiently as to be unacceptable for CT and other precision applications.

One solution was to construct the bearing housing from stainless steel or other stronger metals. However, stainless steel lacked the thermal conductivity of copper. In high energy x-ray tubes, the stainless steel and heat radiation across the vacuum taken together were inadequate to remove the generated heat.

Another solution was to use a strengthened high thermal conductivity alloy, particularly a dispersion strengthened copper alloy. In order to maintain the vacuum, it was necessary to form a vacuum seal between the vacuum envelope and the shank. This seal was commonly performed by brazing. In a glass envelope tube, the glass was connected with a Kovar metal, which, in turn, was brazed to the copper bearing housing. Although pure copper was readily brazed to form this vacuum-tight seal, the dispersion strengthened copper alloy did not braze reliably.

The present invention provides a new and improved mounting arrangement which overcomes the above-referenced problems and others.

SUMMARY OF THE INVENTION

In accordance with the present invention, a rotating anode x-ray tube is provided. A rotating anode and bearing assembly is mounted in a vacuum envelope. The bearing assembly is mounted in a copper bearing housing to which the vacuum envelope is connected in a vacuum sealing relationship. A copper shank connected with the copper bearing housing extends from the vacuum envelope. A reinforcing member which has less thermal conductivity but higher mechanical strength is connected with the copper shank for supporting the copper shank and at least a portion of the copper bearing housing.

In accordance with a more limited aspect of the present invention, the reinforcing structure includes a reinforcing collar which surrounds the copper shank and a flared seat which supports an adjacent end of the copper bearing housing.

In accordance with another more limited aspect of the present invention, the vacuum envelope includes a ceramic portion and a Kovar metal portion, the Kovar metal portion is sandwiched between the copper bearing housing and the seat of the reinforcing member.

In accordance with a yet more limited aspect of the present invention, the reinforcing structure, the Kovar vacuum housing portion, and the copper shank and bearing housing are brazed together.

One advantage of the present invention is that it increases the structural strength of the mounting arrangement for x-ray tubes permitting larger, more massive rotating anode and bearing assemblies to be supported.

Another advantage of the present invention is that it retains the high thermal conductivity and excellent brazing properties of high purity copper.

Another advantage of the present invention is that it is simple and inexpensive.

Still further advantages of the present invention will become apparent to those of ordinary skill in the art upon reading and understanding the following detailed description of the preferred embodiment.

BRIEF DESCRIPTION OF THE DRAWINGS

The invention may take form in various components and arrangements of components and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
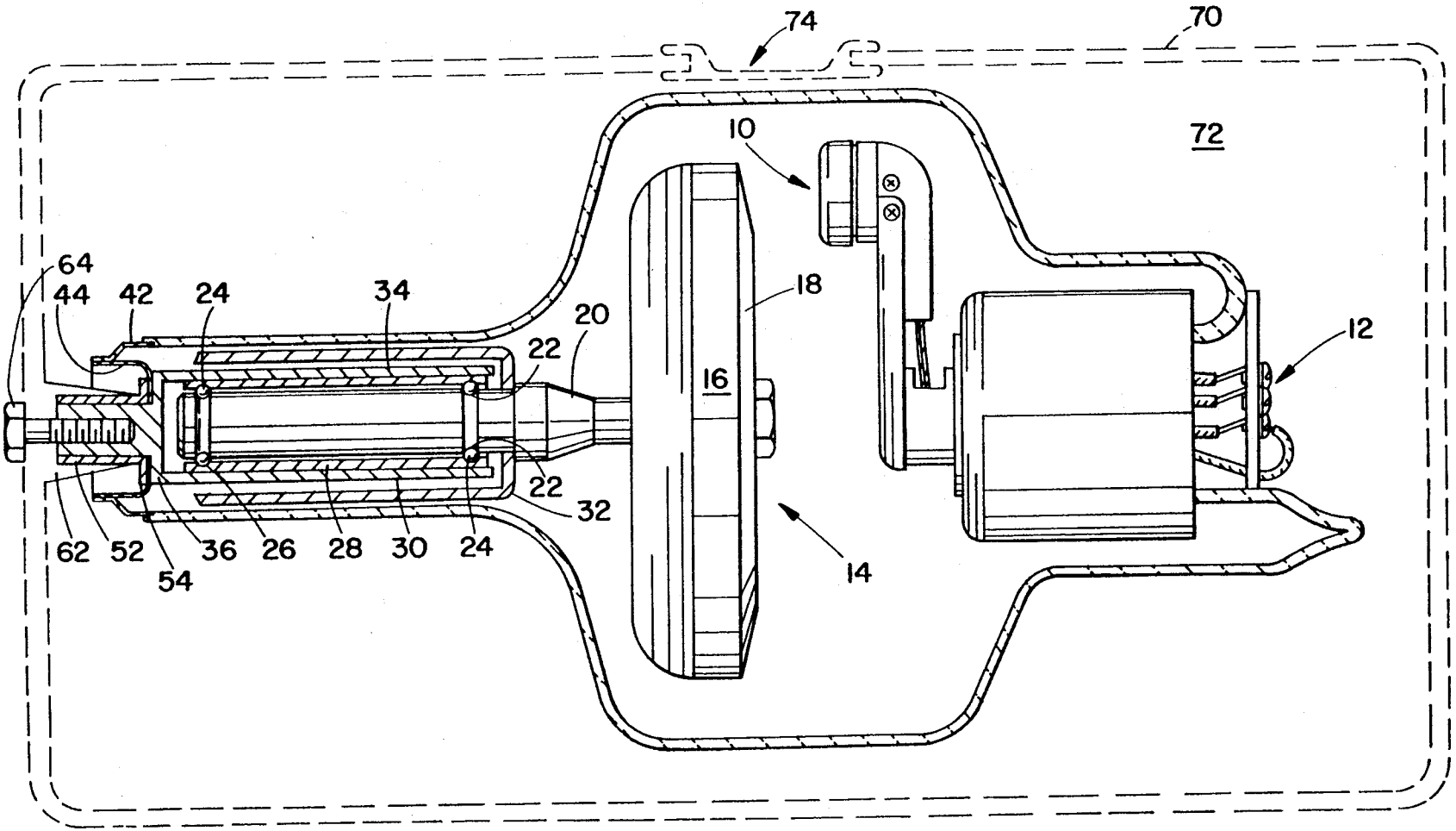
FIG. 1 is a diagrammatic view in partial section of a rotating anode x-ray tube in accordance with the present invention.
Figure 2:
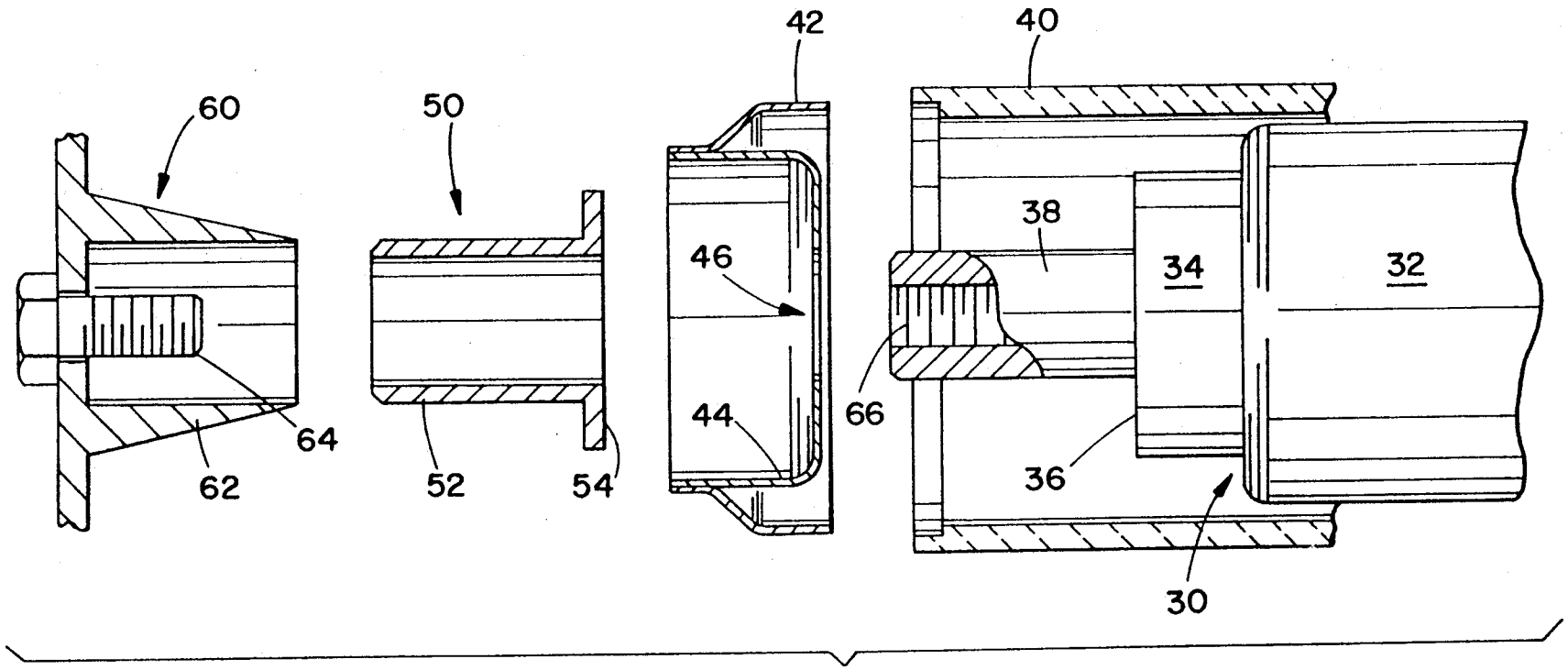
FIG. 2 is an exploded, enlarged view of the mounting portion of the x-ray tube of FIG. 1; and, FIG. 3 is an alternate embodiment of the mounting arrangement of FIG. 1.

With reference to FIGS. 1 and 2, a cathode 10, such as a cathode cup, is heated to generate a cloud of electrons. Commonly, a heating current is applied at leads 12 to put a sufficient current through a cathode filament contained within the cup that electrons are emitted. The electrons are caused to strike an anode 14 by applying a large electrical potential across the cathode and anode, e.g 150 kV. The anode includes a circular disk-like body portion 16 on which an annular anode track 18 is defined. Preferably, the annular track or path 18 is defined by an annular tungsten strip which is integrally bonded to the body portion 16. Optionally, the body and track portions may be a single, unitary structure.

The anode is mounted on a stem 20, preferably of molybdenum. The stem defines inner bearing races 22. A plurality of ball or other bearing members 24 are received between the inner bearing races 22 and outer bearing races 26 in an outer bearing member 28.

The outer bearing member 28 is frictionally received in a high purity copper bearing housing 30. To improve thermal transfer between the anode stem 20 and the bearing housing 30, a peripheral shroud 32 conducts heat from the stem 20 into close proximity to the bearing housing 30 to improve thermal transfer. The bearing housing defines cylindrical bearing containing walls 34 which merge at a shoulder portion 36 into a mounting shank 38.

A vacuum envelope includes a glass or ceramic portion 40 which is sealed to a Kovar metal portion or sleeve 42. A Kovar metal cap or end member 44 defines a central aperture 46 though which the shank 38 is received. The Kovar portions are welded into a vacuum-tight seal. The Kovar metal cap or end portion is brazed to the copper bearing housing shoulder portion 36.

A reinforcing member 50 includes a collar or sleeve portion 52 which surrounds and is brazed to the shank 38. The collar portion 52 is integral with a seat portion 54 which abuts the Kovar cap 44 and copper bearing housing shoulder 36. More specifically, the edges of the cap surrounding the central aperture are brazed between the reinforcing member seat and the bearing housing shoulder. In the preferred embodiment, the reinforcing collar 50 is constructed of steel, preferably low carbon steel.

A mounting assembly 60 receives and anchors the copper shank 38 to support the bearing and anode assembly in a cantilevered relationship. It should be noted that supporting structures (not shown) for the x-ray tube envelope adjacent the cathode end provides substantially no support to the anode assembly. The anode mounting assembly includes a chuck portion 62 which frictionally engages the reinforcing collar 50 A screw member 64 is threadedly received in a threaded central aperture 66 of the shank 38 As the screw member 64 is threadedly received in the shank 38, the copper shank is kept in tension, increasing the structural strength and stability with which the anode is mounted.

To improve heat removal, an outer housing 70 surrounds the x-ray tube to define an oil-filled region 72. Oil circulating means (not shown) circulate the oil to a remote heat exchanger where heat is removed and cool oil is returned. An x-ray permeable window 74 is defined in the housing from which the generated x-ray beam is emitted.

Figure 3:
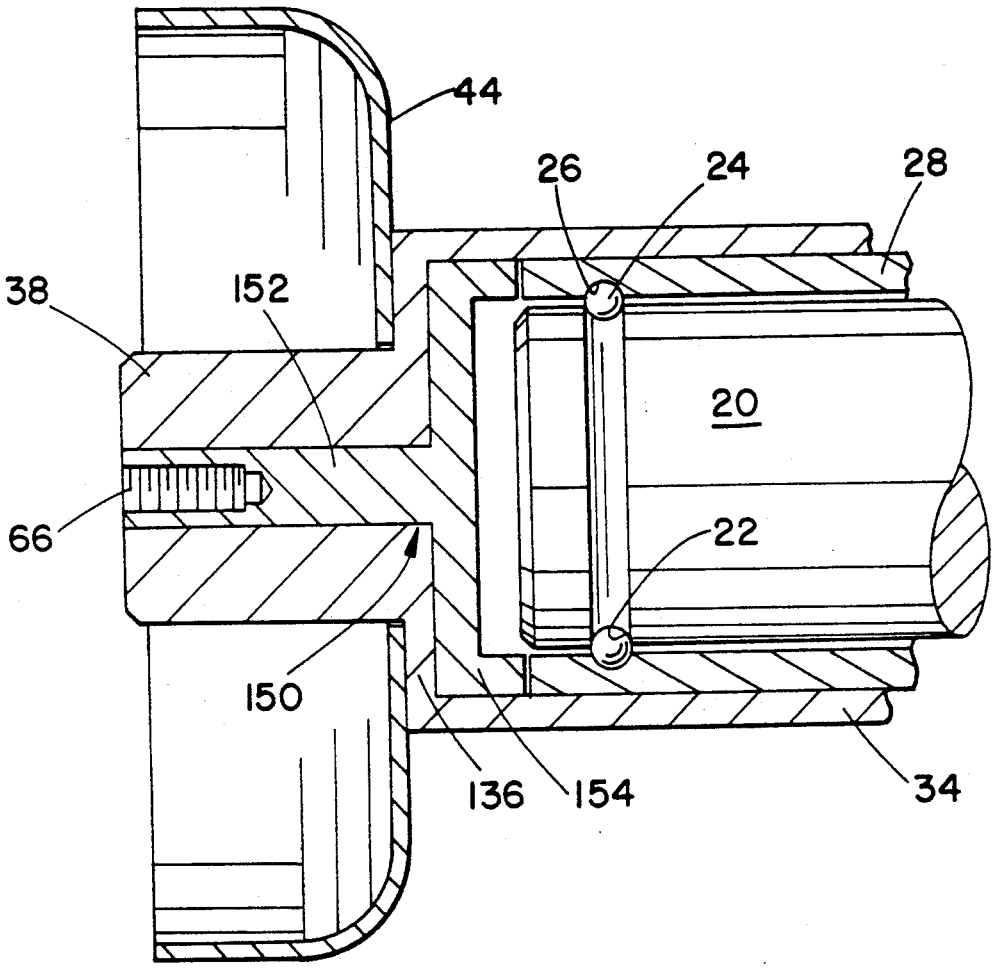

With reference to FIG. 3, other reinforcing members are also contemplated. For example, a steel reinforcing member 150 may include an axial portion 152 extending down a central portion of the copper shank 38. The threaded mounting aperture 66 is defined in the central axial portion 152. An annular seat portion 154 reinforces the shoulder portion 36 of the copper bearing housing. The Kovar cap 44 is brazed to an exterior surface of the shoulder 36 and the reinforcing member seat portion is brazed to its interior surface. Because the reinforcing member is now within the vacuum region, the reinforcing member is preferably constructed of a metal with minimal outgassing into the vacuum.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. In a rotating anode x-ray tube in which an anode supporting bearing assembly is mounted in a cup-like bearing housing of a high thermal conductivity, the bearing housing including a shoulder portion which connects to a larger diameter cylindrical bearing containing side wall with a mounting shank of high thermal conductivity to define a unitary structure with the shoulder portion extending outward from the mounting shank, the improvement comprising:

a reinforcing member having a first, longitudinal portion extending longitudinally generally parallel to the shank and connected therewith and a second, seat portion which abuts and reinforces the shoulder region, the reinforcing member having greater structural strength than the bearing housing and the shank.

2. In the rotating anode x-ray tube of claim 1, the improvement further comprising:

the reinforcing member first portion being a cylindrical collar portion which surrounds the copper shank, the cylindrical collar portion being connected with the sear portion which supports an outer surface of the shoulder portion.

3. In a rotating anode x-ray tube in which an anode supporting bearing assembly is mounted in a bearing housing of a high thermal conductivity, the bearing housing including a shoulder portion which is connected with a mounting shank of high thermal conductivity, the anode supporting bearing assembly and the bearing housing are mounted within a vacuum envelope which includes a metal flange portion, the improvement comprising:

a reinforcing member having greater structural strength than the bearing housing and the shank and having a cylindrical collar portion which surrounds the high thermal conductivity shank and a seat portion which supports and reinforces an outer surface of the shoulder portion, the vacuum envelope metal flange portion being sandwiched between the reinforcing member seat portion and the bearing housing shoulder portion.

4. In the x-ray tube as set forth in claim 3, the improvement further comprising:

the vacuum envelope metal flange portion, the shoulder portion, the reinforcing member seat portion, the reinforcing member cylindrical collar portion, and the shaft portion being brazed together.

5. A rotating anode x-ray tube comprising:

a vacuum envelope;

a cup-like bearing housing of a high thermal conductivity metal, the bearing housing including a cylindrical side wall which defines a bearing receiving bore therein, the bearing housing cylindrical side wall being unitarily connected with a mounting shank, the vacuum envelope being connected with and sealed to at least one of the bearing housing and the shank in a vacuum tight relationship;

a reinforcing collar surrounding the mounting shank, the reinforcing collar being constructed of a higher strength, lower thermal conductivity material than the mounting shank for reinforcing the shank along its length against deformation;

a bearing mounted in the bearing housing bearing receiving bore;

an anode assembly rotatably mounted to a shaft connected to an inner race of the bearing;

a cathode assembly mounted within the vacuum envelope across from a portion of the anode.

6. The x-ray tube as set forth in claim 5 wherein the bearing housing and shank are constructed of high purity copper and the reinforcing collar is constructed of steel.

7. The x-ray tube as set forth in claim 5 further including a reinforcing seat of the higher strength, lower conductivity material unitarily connected to the reinforcing collar and extending radially outward therefrom, the reinforcing seat abutting an adjacent end of the bearing housing cylindrical side wall, whereby the reinforcing seat inhibits the bearing housing cylindrical side wall from sagging relative to the mounting shank due to weight of the anode assembly.

8. A rotating anode x-ray tube comprising:

a bearing housing of a high thermal conductivity metal, the bearing housing defining a bearing receiving bore therein, the bearing housing being connected with a mounting shank;

a reinforcing collar surrounding the mounting shank, the reinforcing collar being constructed of a higher strength, lower thermal conductivity material than the mounting shank;

a reinforcing seat integrally connected with the reinforcing collar;

a vacuum envelope including a portion which is received between the reinforcing seat and a mating surface of the bearing housing and is sealed therebetween in a vacuum tight relationship;

a bearing mounted in the bearing housing bearing receiving bore;

an anode assembly rotatably mounted to the bearing;

a cathode assembly mounted within the vacuum envelope across from a portion of the anode.

9. The x-ray tube as set forth in claim 8 wherein the bearing housing and shank are integrally constructed of high purity copper and the reinforcing collar and seat are constructed of steel and wherein the received vacuum envelop portion is constructed of metal; the reinforcing seat, the received vacuum envelop portion, and the bearing housing mating surface being brazed together.

10. The x-ray tube as set forth in claim 8 wherein the collar and the shank have substantially the same length and further including a threaded bore tapped axially in the shank such that a threaded connector places the shank under tension with the collar abutting a mounting surface.

11. A rotating anode x-ray tube comprising:

a vacuum envelope;

a bearing housing of a high thermal conductivity metal, the bearing housing having a cylindrical side wall which defines a bearing receiving bore, the bearing housing side wall being connected at a shoulder region with a mounting shank, the shoulder region extending outward from the shaft, the shaft and the bore being in alignment, the vacuum envelope being connected with and sealed to at least one of the bearing housing and the shank in a vacuum tight relationship;

a bearing mounted in the bearing housing bearing receiving bore, an anode assembly rotatably mounted to the bearing;

a reinforcing seat affixed to and surrounding the shoulder region, the reinforcing seat being constructed of a higher strength, lower thermal conductivity material than the bearing housing and the mounting shank, such that the reinforcing seat reinforces the shoulder region against the bearing housing side wall sagging out of alignment with the shaft due to weight of the anode assembly;

a cathode assembly mounted within the vacuum envelope across from a portion of the anode.

12. The x-ray tube as set forth in claim 11 further including a reinforcing member which is connected with the reinforcing seat and which is affixed to and extends generally longitudinally along the mounting shank.

13. The x-ray tube as set forth in claim 12 wherein the bearing housing side wall, shoulder region, and shank are integrally constructed of high purity copper.

14. The x-ray tube as set forth in claim 13 wherein the reinforcing member and the reinforcing seat are integrally constructed of steel.

15. The x-ray tube as set forth in claim 12 wherein the reinforcing member surrounds the shank.

16. A rotating anode x-ray tube comprising:

a vacuum envelope;

a bearing housing of a high thermal conductivity metal, the bearing housing having a cylindrical side wall which defines a bearing receiving bore, the bearing housing side wall being connected at a shoulder region with a mounting shank, the vacuum envelope being connected with and sealed to at least one of the bearing housing and the shank in a vacuum tight relationship;

a reinforcing seat affixed to and surrounding the shoulder region, the reinforcing seat being constructed of a higher strength, lower thermal conductivity material than the bearing housing and the mounting shank;

a reinforcing member which is connected with the reinforcing seat and which is affixed to and extends generally longitudinally along the mounting shank, the reinforcing member and the shank having substantially the same length and further including a threaded bore tapped axially in one of the reinforcing member and the shank;

a bearing mounted in the bearing housing bearing receiving bore;

an anode assembly rotatably mounted to the bearing;

a cathode assembly mounted within the vacuum envelope across from a portion of the anode.

* * * * *